United States Patent [19]

Browning

[11] 4,319,647

[45] Mar. 16, 1982

[54] FLAME DRILL CHANNELLING METHOD AND APPARATUS FOR REDUCING NOISE AND DUST LEVELS

[75] Inventor: James A. Browning, Hanover, N.H.

[73] Assignee: Browning Engineering Corporation, Hanover, N.H.

[21] Appl. No.: 140,934

[22] Filed: Apr. 16, 1980

[51] Int. Cl.[3] ..... E21B 7/14

[52] U.S. Cl. ..... 175/14; 175/209

[58] Field of Search ..... 175/14, 15, 16, 209, 175/210, 211, 212

[56] References Cited

U.S. PATENT DOCUMENTS

| | | | |
|---|---|---|---|
| 2,341,322 | 2/1944 | Hubbell | 175/220 |
| 2,675,993 | 4/1954 | Smith et al. | 175/212 |
| 2,693,937 | 11/1954 | Wyland, Jr. | 175/14 |
| 3,467,206 | 9/1969 | Acheson et al. | 175/15 |
| 4,029,160 | 6/1977 | Leidvik | 175/212 |

*Primary Examiner*—James A. Leppink

*Attorney, Agent, or Firm*—Sughrue, Mion, Zinn, Macpeak & Seas

[57] ABSTRACT

Chanelling in rock quarries with reduced noise level is effected by flame drilling side by side holes separated by a web with the web sufficiently thin to allow easy subsequent breakage, preferably where the web is badly heat damaged and cracked through. Water injection acts together with the muffler effect with drilling restricted to individual holes separated by the web to significantly reduce noise levels. The flame drill is preferably additionally provided with a muffler of "folded" design to increase the gas flow path over a short vertical dimension. The muffler may comprise multiple concentric tubes with the inner of the tubes bearing holes for transmitting flow radially of longitudinal flow paths defined by opposed concentric tube walls. A refractory cloth annulus secured to the top of the muffler may be spring held to the stem of the flame drill assembly. A tubular multi-layer refractory cloth seal end to end affixed to the muffler and facing the rock formation limits escape of noise and dust at the flame impact area with the edge of the tubular cloth seal forcibly pressed against the rock surrounding the hot gas and abrasive particle impringement area.

4 Claims, 5 Drawing Figures

FLAME DRILL CHANNELLING METHOD AND APPARATUS FOR REDUCING NOISE AND DUST LEVELS

FIELD OF THE INVENTION

This invention relates to a method of channelling in rock quarries and more particularly to an improved flame drill channelling method as well as apparatus for reducing the noise and dust level of the flame drill during its use.

BACKGROUND OF THE INVENTION

Rock formations have been subjected to continuous channelling using internal burning devices as set forth in some detail in U.S. Pat. No. 3,019,004 issuing Jan. 30, 1962, to J. F. Vasselin and U.S. Pat. No. 3,013,251 issuing Sept. 10, 1963 to applicant. Applicant has had considerable experience in the use of internal burners for channelling in earth and rock formations, and applicant has for many years tried by various means to quiet the process and to reduce the concentration of respirable dust particles. It is not uncommon for the operator to be working in a virtual cloud of dust and at noise levels far greater than 125 db. Such situations are hardly tolerable.

It is, therefore, a primary object of the present invention to provide an improved flame drill channelling method and an improved flame drill apparatus which acts both to reduce noise and dust levels during use of the same, particularly in comparison with conventional continuous channelling by non-equipped internal burning devices of the type set forth in the prior art listed above.

SUMMARY OF THE INVENTION

The present invention, in one aspect, is directed to a flame drill channelling method characterized by reduced noise and dust levels by feeding a flame drill burner downwardly flame first into a rock mass at a rate producing bore holes of given diameter to a predetermined depth, removing the flame drill from the bore hole and causing the flame drill burner to be fed downwardly flame first into said rock mass at an adjacent position with the improvement residing in the creation of completely separate small diameter bore holes in transverse alignment but spaced from each other by a slight degree to form thin rock webs and breaking the webs between the spaced holes to open the channel such that the flame drill in forming the separate holes has the resulting sound muffled and the dust created by drilling substantially reduced.

Preferably, the immediate area of flame impingement of the flame drill facing the rock formation being drilled is muffled and a liquid is sprayed into the bore hole from a point immediately above the flame impingement area to substantially reduce free particles of dust created during the drilling process. Control of the water spray insures that all of the sprayed liquid droplets are changed to steam due to the generated heat by the flame drill so as to maximize the reduction in free particles of dust.

In another aspect of the invention, a folded radially spaced multiple concentric tube or muffler concentrically surrounds at least the cylindrical heater and the flame impact area being mounted at the end of the burner and bears a tubular refractory cloth seal at the end thereof facing the rock formation and surrounding the immediate flame impact area. The muffler may comprise a pair of concentric tubes with an end wall closing off the ends of the tubes opposite the rock surface and wherein the apertured are provided within the first tube such that generated gases, dust, etc. flow through a first annular space defined by the first tube and the burner passes radially through the apertures within the first tube adjacent the end wall of the muffler, reverses flow and passes through a second annular space defined by the first and second tubes prior to escaping about the end of the outer tube and passing vertically upwardly to the bore hole. The muffler may be mounted for relative movement with respect to the tubular flame drill concentrically surrounding the same and a hydraulic cylinder may be provided between the muffler and a fixed reference point to press the refractory cloth tubular seal against the rock being drilled to follow the drilling process.

DESCRIPTION OF THE PREFERRED EMBODIMENTS

The present invention is directed, in part to a new flame drill channelling method as applied to rock quarries and like earthen formations. The method employed reduces both noise and dust to acceptable levels as compared to conventional continuous channelling, which may employ essentially similar internal burner devices as set forth in the United States patents referred to previously. Continuous channelling is characterized by leaving one side of the channel open when lowering of the flame drill carves out a limited portion of the rock formation to enlarge the channel being drilled.

Figure 1:
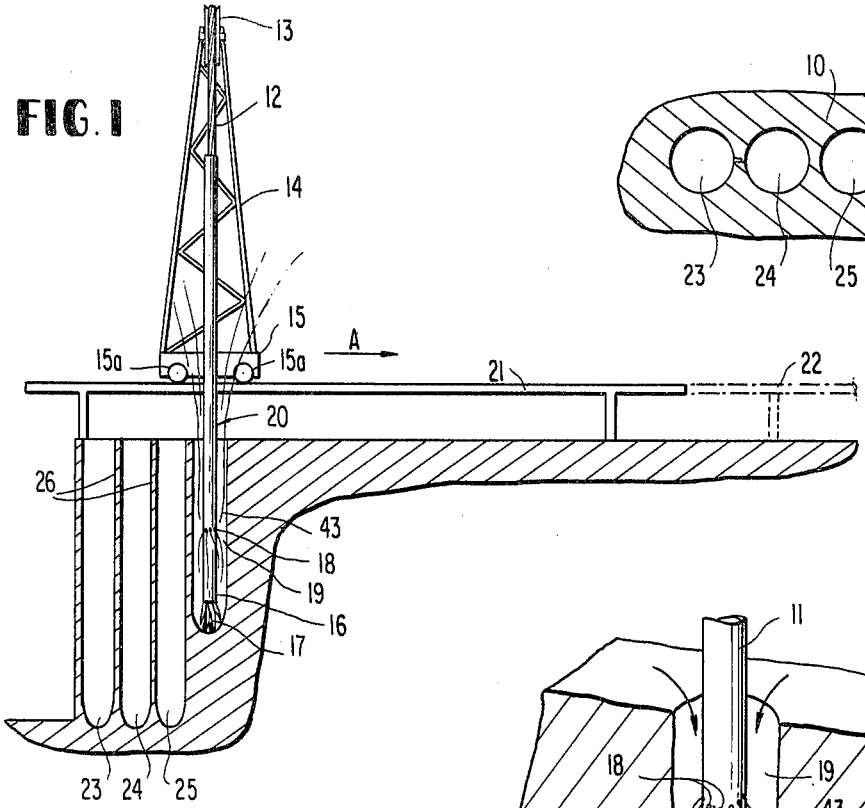
FIG. 1 is a vertical cross-sectional view of a drill unit in operation utilizing the improved flame drill channelling method of the present invention with appreciably reduced noise and dust levels.

By reference to FIG. 1, under the process of the present invention series of three complete holes 23, 24 and 25 are shown as vertically drilled by a flame drill indicated generally at 20. The drill 20 in the process of drilling a fourth hole 19 in transverse alignment with the other holes 23, 24 and 25 with the holes being separated from each other only by thin webs as indicated at 26. The flame drill 20 is suspended by a plurality of hoses forming a hose assembly 12, the hose assembly 12 passing over a sheave 13 which is mounted for rotation about its axis at the top of tower 14. Tower 14 rides on a carriage 15 by way of wheels 5*a* such that the carriage may be shifted laterally in the direction of arrow A along a line thus forming the holes 23, 24, 25 etc. High velocity jet burner 16 produces a flame 17 capable of drilling into the rock mass 10 by a thermal spalling process. A better and complete understanding of this flame drilling technique may be seen by reference to U.S. Pat. No. 3,463,249 issuing Aug. 26, 1969, to applicant.

Figure 2:
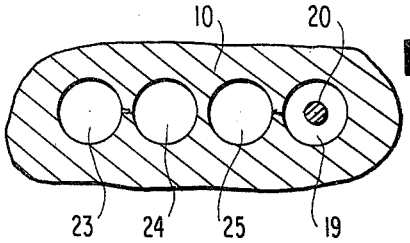
FIG. 2 is a plan view of the series of drill holes utilized in the flame drill channelling method of FIG. 1.

As an aspect of the invention, the drill 20 utilizes water cooling as an effective means for cooling of the drilling apparatus and to reduce dust concentrations. Water is directed into the hole 19 in the form of jet streams 43 emanating from holes 18 with the drill 20. The water jets of the jet streams 43 are nearly instantly torn apart to form a fine suspension of droplets in the hot rising stream of gases and drill cuttings from the flame area 17 below the holes 18 and at the bottom of burner 16. While it is possible to drill "dry", that is, with the cooling water being returned to above ground, the present invention advantageously mixes this water into the hot gases and dust. The cooling of the gases together with the spray particles helps to reduce noise intensity. These spray particles also reduce dust concentration, and it has been found by the process of the present invention that it is much more effective to allow the droplets to change into steam. When the steam condenses, it condenses on the dust particles, reducing "free" particles of dust to a minimum. To make an appreciable amount of steam, the drill 20 must be well down the hole 19. Thus, as may be appreciated, there is more of a dust problem during the first several feet of drilling of the hole than during the remaining drilling of the balance of that hole. However, as will be appreciated further, by use of a properly designed muffler, as evidenced in FIGS. 4 and 5, the dust problem can be minimized, even during the initial penetration of the rock formation 10. In the process of the present invention, as illustrated in FIGS. 1 and 2, the maximum effectiveness in the reduction of the noise level (also true when using the muffler of FIGS. 4 and 5) occurs when the individual holes as at 23, 24, 25, 19 are separate by webs as at 26 of a preferred thickness relative to the rock or other earth formation being drilled. Where the process is the eventual formation of a laterally extending channel or slot, the webs must be thin enough to allow easy subsequent breakage, and preferably it has been ascertained that the stone of relatively thin webs up to one inch or so thick) is badly heat-damaged and even cracked through at local places. This is seen in FIG. 2, where certain of webs 26 are shown to be cracked through at 26' while another web in that figure is unbroken. However, any thin web can be easily broken by impact or by hydraulic splitting.

By leaving thin webs as at 26, between holes, the only outlet for noise is up and out of the hole. Preferably, the drill 20 is supplied with a muffler as per FIGS. 4 and 5 such that together with the muffler effect and the water injection, noise levels of under 85 bd (measured 10 feet from the muffler at ground level) are effected. Even without a muffler, with the burner more than four feet into the hole, noise levels are normally under 95 db.

Figure 4:
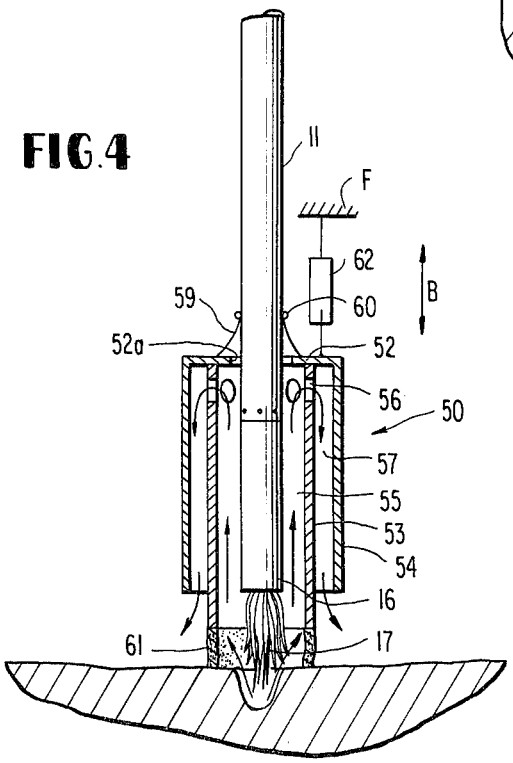
FIG. 4 is a vertical cross-sectional view of a flame drill bearing one embodiment of a noise and dust reducing muffler forming one aspect of the present invention.
Figure 5:
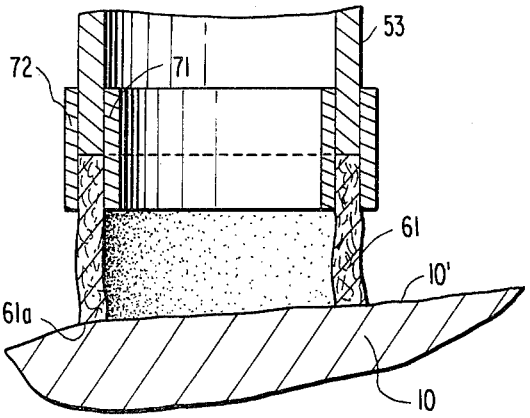
FIG. 5 is an enlarged, detailed view of the lower portion of the muffler of FIG. 4 in contact with the rock formation being drilled.

Reference to FIGS. 4 and 5 illustrates a one form of highly effective muffler of the present invention. The muffler indicated generally at 50 is a "folded" type to allow a relatively long gas flow path over a short vertical dimension. Basically, the muffler comprises two concentric tubes, an inner tube 53 and an outer tube 54, the tubes may be formed of metal or the like. The tubes must be sized so that the diameter of the outer tube 54 is not wider than the bore hole, as at 19, being formed by the impinging flame 17. The outer tube 54, while open at its bottom, is closed off at its top by an end wall 52 which extends inwardly and overlies the upper end of the inner concentric tube 53, except for a central opening **52*a*. The combustion gases, steam and dust rise up through the annular passage 55 between burner 16 of the flame drill 11 and the inner tube 53, and pass radially through multiple holes 56 into a second annular chamber 57 defined by the inner and tubes 53 and 54, wherein the gases pass downwardly and around the lower end of the outer tube 54**.

For maximum effectiveness, the muffler tube 53 must be sealed as well as possible to prevent the gases, steam and dust from escaping between the flame drill 11 and the muffler, particularly at opening **52*a* through which projects burner 16 as an integral portion of the rodlike drill stem of drill 11. A relatively thick annular sleeve 59 of refactory cloth forming tubular seal is secured at one end to the end wall 52 forming the top of muffler 50 and is held firmly at its other end against the stem of the drill 11 by a circumferential spiral ring 60. As may be appreciated, the drill stem may slide inside the spring 60**.

The muffler-to-rock seal is a much more critical problem. Hot gases and abrasive particles impinge against the muffler-to-rock seal. The rock surface is usually not flat. As seen in FIG. 5, the rock formation 10 has a slanting surface 10' at the point of contact. The inner muffler tube 53 approaches to within a couple of inches of the surface 10' of the rock formation. Attached to its end face is a seal assembly comprising inner and outer metal rings or bands 71 and 72 respectively. These rings hold a thick tubular seal 61 formed of multiple layers of refractory cloth. A hydraulic cylinder 62, FIG. 4, is interposed between the muffler and a fixed point of reference as at F which could, for instance, be an element fixed to the drill stem at some point above the muffler 50, such that by application of hydraulic force, the muffler 50 is shifted up and down as indicated by the double headed arrow B to adjustably position the muffler with respect to burner 16 and to press the lower edge **61*a* of the refractory cloth tubular seal against the surface 10' of the rock. The refractory cloth tends to conform to the shape of the rock surface at its lower end, thus providing a highly efficient and required seal. Without the seals created with rock mass 10 by members 59 and 61**, the noise and dust can readily escape.

Figure 3:
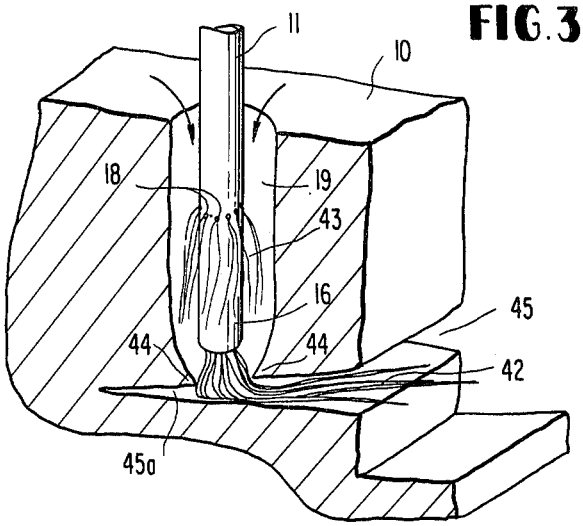
FIG. 3 is a perspective view of the channelling method employing the flame drill apparatus of FIG. 1 and illustrating the effect caused by the flame drill impinging a large open crack in the rock formations.

In many practical situations, cracks and seams may be present in the rock mass. If such a natural earth or rock formation discontinuity yields alternate access to the atmosphere, the flame gases 42, FIG. 3, pass out of the crack opening 45. A small collar 44 is created with rock mass 10 which is just large enough to allow the flame-jet 17 to pass into the crack opening **45*a*. If water flow 43 is present, it also passes down the hole 19 by aspiration and into the crack 45. Flame spalling due to cooling by this water ceases. It is thus necessary to provide a drill design in which the cooling water can alternately be directed to spray holes as at 18 or returned internally to the surface. In the absence of the water, the hot flame is usually able to pass through such a crack and function to continue drilling by spalling action. The present invention utilizes a simple valving technique (not shown) to allow either mode of water flow, that is, through holes 18 forming the water spray flow at 43 or alternatively returning the water which is employed in cooling the drill burner 16 to the surface without escape from the drill 11 by way of the small holes 18. When the operator notes that the gases have reversed direction, that is, failed to rise vertically upwardly, he eliminates the water externally of burner 16 flow to the hole 19. When the gases again exit out of the top of the hole, the water can be discharged to the hole 19 by way of openings 18**.

Drilling without a muffler may result in the gas steam and dust being thrown up to fifty feet into the air, the embodiment of the invention of FIG. 1 directed to the improved channelling method does not illustrate the burner 16 as incorporating a muffler (such as that shown in FIGS. 4 and 5). Needless to say, the discharge to such a height of the gases, steam and dust is highly objectionable. The muffler 50 serves to direct its effluent as well as to suppress noise created during the drilling process. For maximum dust suppression, the muffler 50 should be of a length which will allow an appreciably amount of suspension of water to form into steam.

The carriage 15 of FIG. 1 passes on the wheels 15*a* along rails 21. For the creation of relatively long lateral channels, a second set of rails 22 must be provided. As may be appreciated, when the drill passes onto rails 22, the rails 21 can be repositioned beyond rails 22, and so forth, to further extend the channel.

While the present invention is described with the drilling of rock or earth formations, there are other processes where an impact surface is other than rock or earth. For example, noise and dust can be effectively controlling during the blast-cleaning of metal and other surfaces by the employment of the muffler illustrated in FIGS. 4 and 5.

While the invention has been particularly shown and described with reference to preferred embodiments thereof, it will be understood by those skilled in the art that the foregoing and other changes in form and details may be made therein without departing from the spirit and scope of the invention.

What is claimed is:

1. A method of flame drilling of a rock mass or the like with reduced noise and dust levels, said method including:

feeding of a flame drill burner downwardly, flame first into said rock mass at a rate producing a bore hole of given diameter, muffling the immediate area of the flame impingement at the end of the flame drill facing said rock formation being drilled and at the bottom of the bore hole during its creation by confining the area of flame impingement within a cylindrical member borne by the flame drill at its lower end including a seal at an end of the concentric muffler tube projecting beyond the end of the flame drill and in contact with the bottom of the bore hole, and spraying a liquid into the bore hole, exteriorly of the drill burner within said cylindrical muffler tube from a point immediately above the flame impingement area to create, as a result of the high temperature operation of the flame drill, steam to substantially reduce free particles of dust created during the drilling process; thereby reducing both the noise generated during flame drilling and the dust created thereby to acceptable levels.

2. In a flame drill comprising a tubular assembly for movement axially towards and away from a rock mass or the like and including a tubular jet flame burner at the end of said tubular assembly facing said rock mass, whereby flame inpingement from said end of said burner progressively creates a bore hole within the rock formation by flame spalling, the improvement comprising:

a folded tube muffler concentrically surrounding at least said tubular jet flame burner at the end of said tubular assembly facing said rock mass and the flame impact area, said tubular muffler comprising at least one cylinder mounted to the tubular jet flame burner, projecting beyond the end of said jet flame burner and bearing a tubular seal interposed between the end of the muffler tube and said rock mass, and means for spraying water from said flame drill into said bore hole at a point immediately above the tubular jet flame burner and between the burner and the concentric muffler tube whereby the heat of the flame impingement area causes all of the sprayed liquid droplets to change into steam under flame drill operation such that the steam upon condensing, condenses on dust particles to maximize the reducing of free particles of dust, and wherein said folded muffler comprises means for causing gas flow to pass over an elongated path of short vertical dimension prior to escaping from the muffler to said bore hole.

3. The flame drill as claimed in claim 2, wherein said muffler comprises multiple concentric muffler tubes which are two in number including an inner tube which bears at its one end facing the rock formation and surrounding the flame impact area, a tubular refractory cloth seal, and said muffler further comprises an end wall closing off the ends of both said concentric muffler tubes at the end of said muffler opposite that facing said rock surface, said end wall being apertured to permit reception of said tubular jet flame burner, a seal surrounding said aperture and bearing on said flame drill tubular assembly, apertures within said inner tube adjacent said end wall, and wherein said inner tube and said burner define a first annular space and said inner and outer tubes define a second annular space, said second annular space being open to said bore hole; whereby, gases and dust are prevented from escaping from the end of said inner tube facing said rock formation due to the presence of said refractory cloth tubular seal and are forced to flow from said first annular space through said apertures within said first tube into said second annular space and by reverse flow to pass through said second annular space defined by said concentric tubes prior to escaping to said bore hole.

4. The flame drill as claimed in claim 2, wherein said muffler is mounted for relative movement on said tubular flame drill, and hydraulic cylinder means are provided between said muffler and a relatively fixed reference point for biasing said refractory cloth tubular seal against said rock formation during drilling to prevent escape of dust and gases from the immediate flame impingement area between the end of said refractory cloth tubular seal and said rock formation surface during progressive drilling and to cause said dust and gases to flow through said muffler annular spaces.

* * * * *